United States Patent [19]

Ehlers et al.

[11] 4,384,522

[45] May 24, 1983

[54] APPARATUS FOR PRODUCING BUSINESS FORMS

[75] Inventors: Dennis W. Ehlers; Robert Lowy; John J. Bradley, all of Green Bay, Wis.

[73] Assignee: Paper Converting Machine Company, Greey Bay, Wis.

[21] Appl. No.: 888,227

[22] Filed: Mar. 20, 1978

Related U.S. Application Data

[63] Continuation-in-part of Ser. No. 858,392, Dec. 7, 1977, abandoned.

[51] Int. Cl.[3] ..... B41F 5/22; B41F 13/20; B41F 13/40

[52] U.S. Cl. ..... 101/177; 101/181; 101/247; 101/352

[58] Field of Search ..... 101/177, 178, 180, 181, 101/182, 179, 247, 220–225, 231, 152, 136, 137, 139, 140, 143, 352, 218; 270/4, 5, 20

[56] References Cited

U.S. PATENT DOCUMENTS

| | | | |
|---|---|---|---|
| 1,640,976 | 8/1927 | Brueshaber | 101/180 X |
| 1,738,324 | 12/1929 | Scott | 101/222 X |
| 2,012,245 | 8/1935 | Meisel | 101/178 |
| 2,185,998 | 1/1940 | Huffman | 101/250 |
| 2,557,381 | 6/1951 | Huebner | 101/180 |
| 2,773,688 | 12/1956 | Fulk | 101/228 X |
| 2,988,989 | 6/1961 | Crawford | 101/181 X |
| 3,041,967 | 7/1962 | Hystrand | 101/247 X |
| 3,190,218 | 6/1965 | Willard | 101/247 |
| 3,323,452 | 6/1967 | Pasquinelli | 101/352 |
| 3,404,626 | 10/1968 | White et al. | 101/181 |
| 3,416,444 | 12/1968 | Cahn | 101/81 |
| 3,892,178 | 7/1975 | Staaman | 101/181 |

FOREIGN PATENT DOCUMENTS

| | | | |
|---|---|---|---|
| 2406509 | 8/1975 | Fed. Rep. of Germany | 101/179 |
| 1003887 | 9/1965 | United Kingdom | 101/178 |

*Primary Examiner*—J. Reed Fisher

*Attorney, Agent, or Firm*—Tilton, Fallon, Lungmus & Chestnut

[57] ABSTRACT

Apparatus for producing business forms made up of a plurality of webs including a plurality of towers, one for each web with each web being equipped with a plurality of vertically related modules for imparting characteristics to the webs, each module being adapted to create a characteristic in the web traveling therepast, and means associated with each tower for changing at least one characteristic in the web traveling therepast.

24 Claims, 20 Drawing Figures

APPARATUS FOR PRODUCING BUSINESS FORMS

This application is a continuation-in-part of our co-pending application Ser. No. 858,392, filed Dec. 7, 1977, now abandoned.

BACKGROUND AND SUMMARY OF INVENTION

This invention relates to apparatus for producing business forms which have multiple web plies and, more particularly, to apparatus which is characterized by flexibility and interchangeability to facilitate production of limited quantities of customized forms.

The cost to produce a "short run" of business forms is significantly higher than that of a longer run—because the set-up time is about the same. Therefore, users of forms have had to compromise—either taking a standardized form which does not meet the users criteria or compromise with quality in the customized forms. One compromise, for example, might be the acceptance of the same color on each web despite the fact that web to web differences have been well known to reduce end-processing errors and usage cost.

In recent years there has been a significant change in the complexity of business forms because the increasing variety of end use applications such as data retrieval and print-out. Thus, the whole trend is to go to more complex forms but the user of limited quantities of forms really was going opposite to the trend because of the inability of the art to produce an economical short run machine. More particularly, the art could not supply a machine with the requisite flexibility for quick change-over to accommodate special requirements, i.e., special characteristics. By the term "characteristics", we refer to characteristics of business forms. Historically, these can be processing characteristics such as gluing, line hole punching, file hole punching, crash numbering, slitting, crimp locking, cross perforation and folding for continuous forms (or cut-off and stacking for snap-out forms; or printing characteristics which include such factors as color, repeat length, image or pattern, distribution (between front and back) and combinations thereof.

Single web processing including duplicate colors and operations for each web plus a secondary and subsequent collating operation of the plurality of webs into multiple copy forms is current commercial practice for short run orders, but higher productivity could be achieved in processing these orders in a one-step operation on a multi-web press if the set-up time could be reduced. A major disadvantage of single web processing-collating includes the handling costs of processed rolls from the single web press to a collator with the attendant risk of damaging rolls that have substantial value added at this process point. It is also noted that single web processing/collating includes a greater number of start-ups with attendant web threading problems which can cause waste, and the problems of length control and register of part to part is also more difficult, vis-a-vis, the multi-web processing method. Other disadvantages of single web processing involves the storage of rolls that have been single web processed before collating and during storage, changing moisture conditions, shrinkage, etc., of these finished rolls.

Simultaneous processing of multiple webs, including functions such as line and file hole punching, perforating, and printing variations, etc., can be performed at higher average speeds than collating machines since simultaneous processing avoids web-to-web mis-register and attendant problems. However, multi-web processing has heretofore been limited to less complicated forms and longer production runs since existing multiple web business forms machines do not permit easy changes or additions of processing steps for individual webs, this flexibility being required for "customized" forms which may include, but are not limited to a selection of: dry offset printing, wet offset printing, flexographic printing, gravure printing, carbon spot printing, numbering, corner cutting, cross perforation, linear perforation, gluing, file hole punching, die cutting, etc.

The inventive apparatus is arranged to permit any combination of these processing steps and defines structures which permit rapid web handling and change-over of unit modules in any combination, thereby allowing greater processing flexibility on shorter production runs when producing forms according to multi-web processing methods.

In one preferred embodiment of the invention, the apparatus includes a plurality of towers arranged in horizontally spaced apart relation in the path of travel of a plurality of webs, viz., one tower for each web. Each tower has a plurality of vertically related modules arranged for vertical web travel therepast and it is these modules which may be changed over rapidly to achieve the heretofore unobtainable flexibility of operation, particularly for short production runs.

Notwithstanding the pressure on the art to develop a versatile apparatus for limited, custom forms, it is surprising that the art workers did not appreciate the instant invention—particularly in view of the fact that interchangeable modules have been known and used for a considerable period as have towers with a plurality of units therein. However, no one had seen fit to combine the two concepts.

The invention also includes a novel characteristic imparting module which facilitates change-over both in whole or in part so as to achieve a significant number of different characteristics in the webs with minimal change-over time. According to the invention, the printing module includes a blanket roll and a plate roll on which a printing plate is mounted. The blanket roll is pivotably mounted relative to the plate roll so that the blanket roll can be pivoted away from the plate roll to provide sufficient access to the plate roll to permit the printing plate to be quickly changed. If the repeat length is to be changed, the blanket roll assembly and the plate roll assembly can be quickly removed from the module and replaced with different size blanket and plate roll assemblies. The ink fountain is also removable so that the ink color can be changed merely by replacing the fountain. Other structures and functions of the invention which optimize multi-web processing in combination with individual single web processing for limited and special forms production can be appreciated from a consideration of the ensuing specification, it being understood that downstream multi-web processing applies to continuous forms when using a folder, or alternately applies to unit sets of business forms when using a cutoff mechanism and stacking delivery system.

DETAILED DESCRIPTION OF THE INVENTION

The invention will be explained in conjunction with an illustrative embodiment shown in the accompanying drawing, in which FIG. 1 is an elevational view of a business forms machine formed in accordance with the invention which includes a plurality of horizontally spaced towers;

Figure 1:
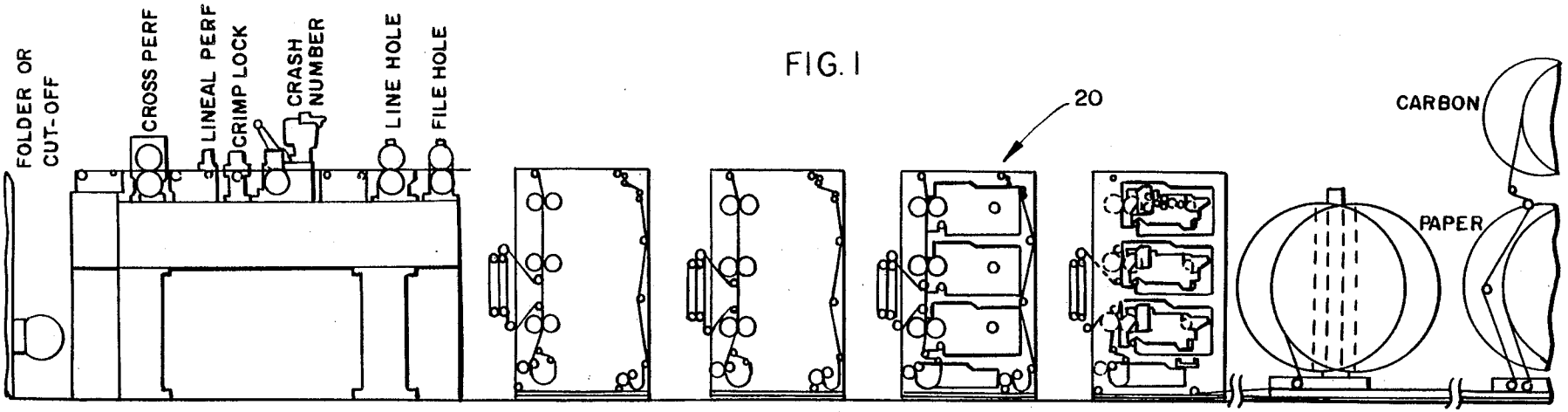
FIG. 1A is an enlarged elevational view of the middle portion of FIG. 1 including two printing modules in tower 23 and one cross perforating module 27*a*.
FIG. 1B is a schematic representation of a turning bar assembly.
Figure 1A:
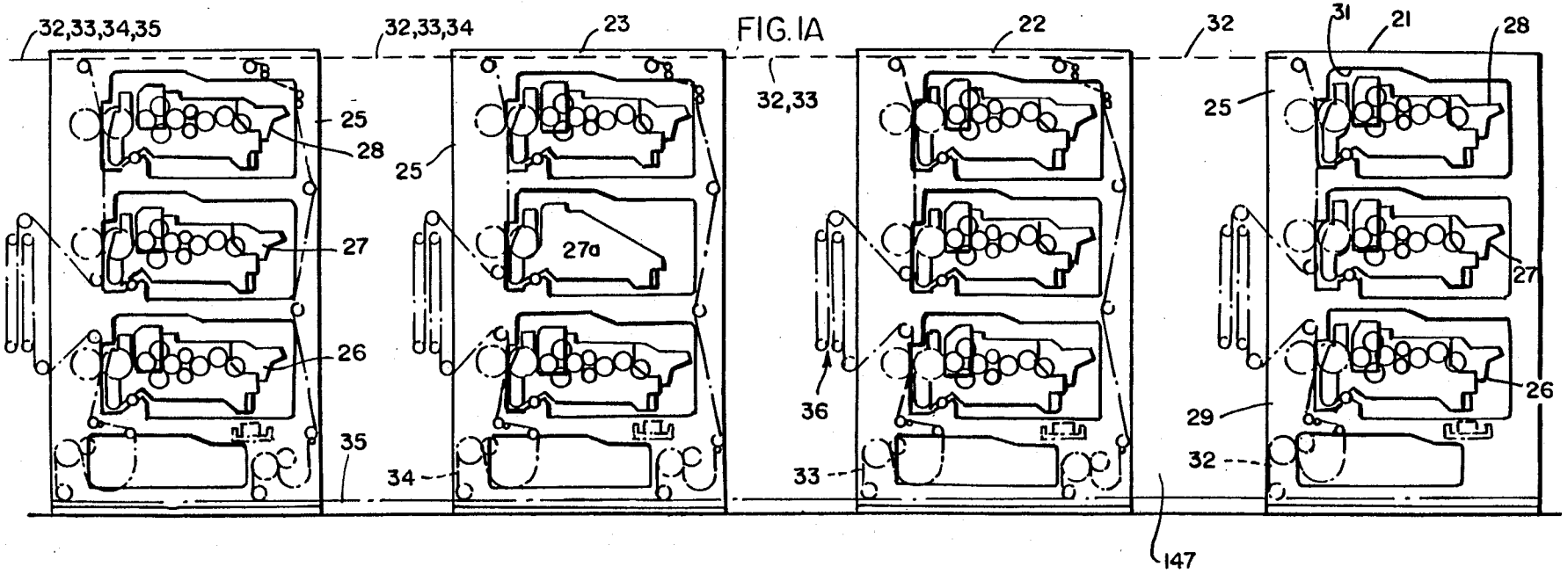
Figure 6:
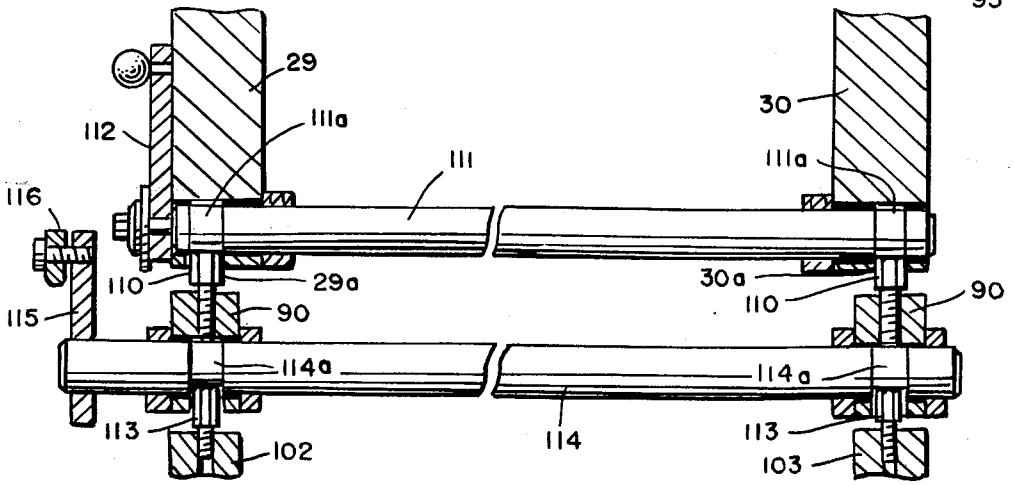
FIG. 6 is a fragmentary cross-sectional view taken along the line 6—6 of FIG. 2.

Referring first to FIGS. 1 and 1A, the numeral 20 designates generally a business forms machine which includes four horizontally spaced towers 21, 22, 23, and 24. The machine also provides a plurality of paper rolls (one for each tower) on suitable unwind stands. Two of these are shown to the right of the towers along with one parent roll of carbon. To the left are provided mechanisms for imparting various processing characteristics simultaneously to all of the superposed webs—as so labeled. Each tower includes a main frame 25 and three vertically spaced modules 26, 27 and 28. The main frame 25 includes vertically extending and horizontally spaced front and rear plates 29 and 30 (see also FIGS. 3, 4, and 6), and the front plate 29 is provided with an opening 31 for each of the modules to permit the module to slide horizontally out of the main frame.

Four paper webs 32, 33, 34 and 35 which are supplied by jumbo or parent rolls (at the right) are fed to the towers 21–24, respectively, and each of the modules of a tower performs a different operation on the web. In the particular embodiment illustrated, all but one of the modules are printing presses and print on either the face or back of the web. A cross perforating module 27*a* is shown in the central position of tower 23.

Each web enters the bottom of the tower, passes vertically through the tower past the modules, and exits at the top of the tower. The four vertically processed webs are superposed as web 35 exits tower 24, and the superposed webs thereafter travel together for further simultaneous processing operations such as hole punching, crimp locking, lineal perforating, and cross perforating.

Figure 1B:
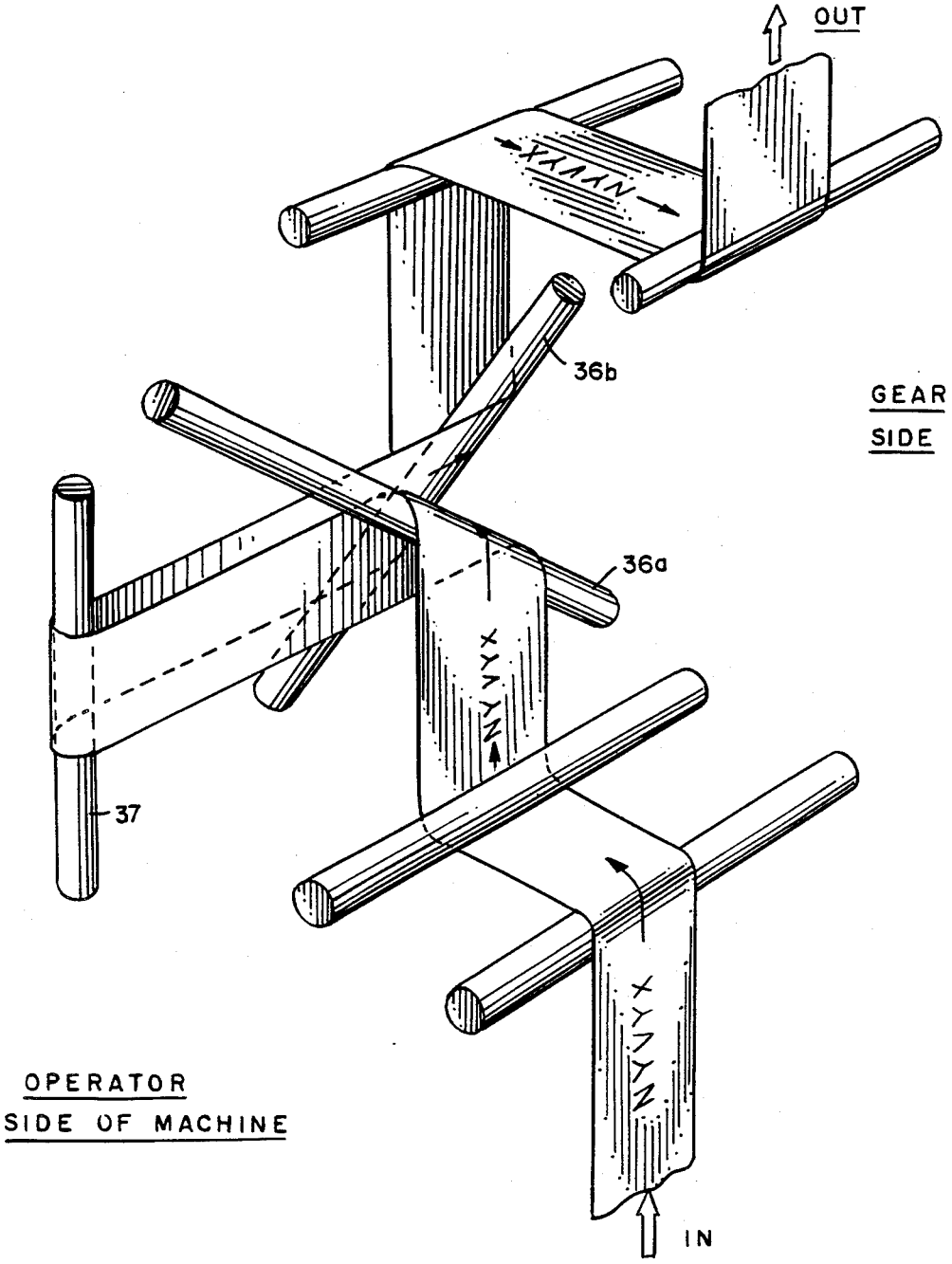

In the embodiment illustrated each of the towers includes a turning bar assembly 36. The lower module 26 prints the back of the web with a particular color, the web is turned over by the turning bars, and the remaining two modules 27 and 28 print two colors on the face of the web. A suitable turning bar assembly is seen in FIG. 1B. As the web of paper courses around the various bars it will be seen that the pattern of "Xs" between adjacent arrows has switched from the near side (to the viewer) to the far side. The structure responsible are the three centrally positioned bars, the outer ones at 36*a* and 36*b* being inclined at opposite 45° angles while the central bar 37 is vertical.

A turning assembly can be interposed between any of the modules, or it can be bypassed by the web. Accordingly, the three printing modules can be used to print two colors on the face and one color on the back of the web, one color on the face and two colors on the back, or three colors on the face or back. It is within the scope of this invention to add a turning bar assembly between towers (Ex: Between 21–22) thus, in the embodiment of FIG. 1, one web could be processed with six characteristics and each of the two remaining webs could be processed with three characteristics.

Figure 2:
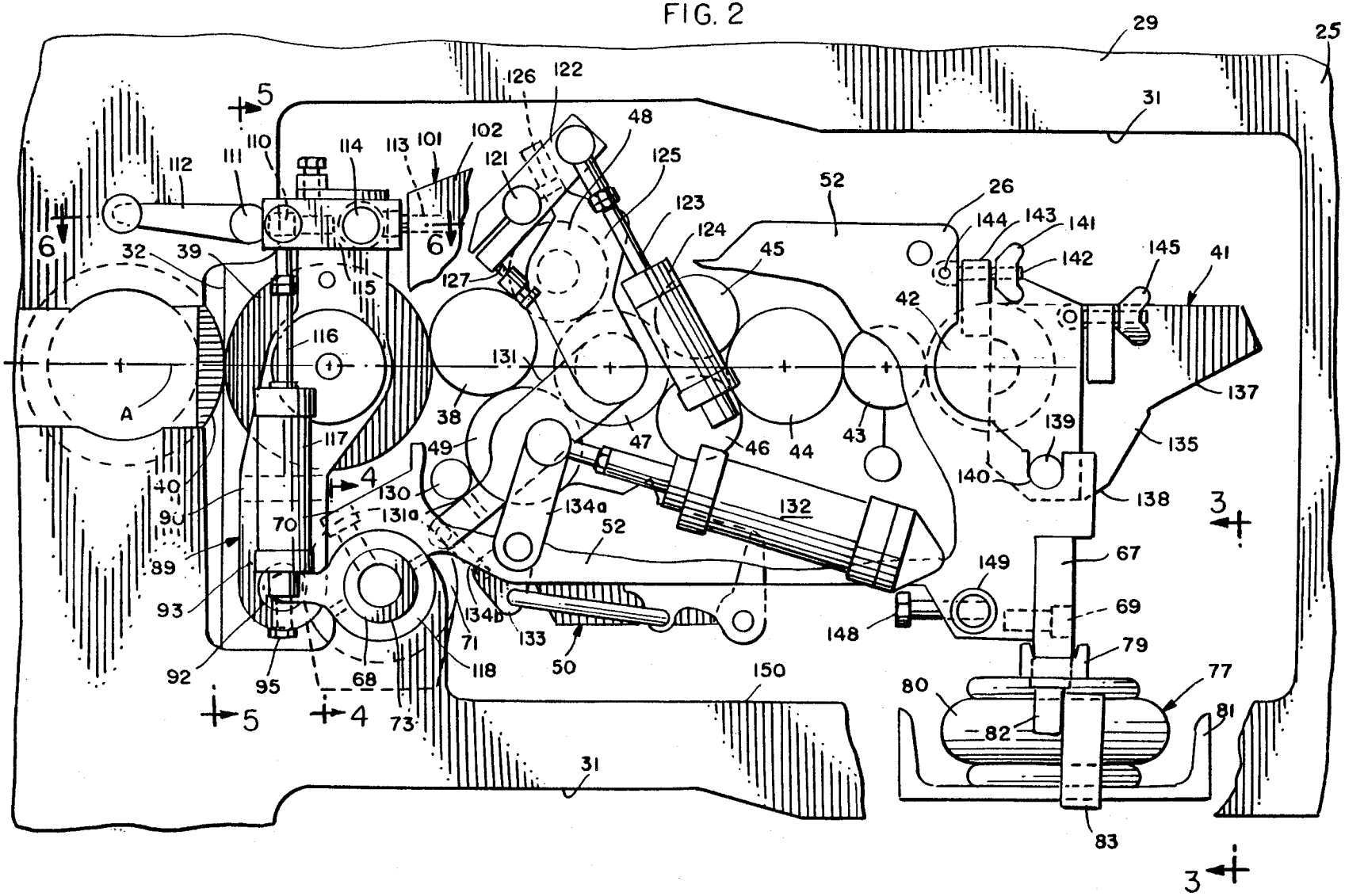
FIG. 2 is an enlarged fragmentary view of one of the towers of FIG. 1A showing one of the modules of the tower.

The details of the printing press module 26 are shown in FIG. 2. The particular press illustrated is a dry offset press, and the module includes a plate roll 38 on which a printing plate is mounted and a blanket roll 39. The blanket roll 39 is positioned adjacent an impression roll 40 on the main frame to form a nip for the web 32, and the blanket roll prints the web as the web passes through the nip.

The printing plate is supplied with ink from a fountain assembly 41 mounted on the right end of the module. The fountain includes a fountain roll 42 which transfers ink to a ductor roll 43, and the ink is thereafter transferred in the conventional manner by a first vibrator roll 44, a pair of distributor rolls 45 and 46, a second vibrator roll 47, and ink form roll 48, and a wet form roll 49. The wet form roll is part of a conventional Dahlgren wetting assembly 50 which supplies a mixture of water and alcohol to the system.

Figure 2A:
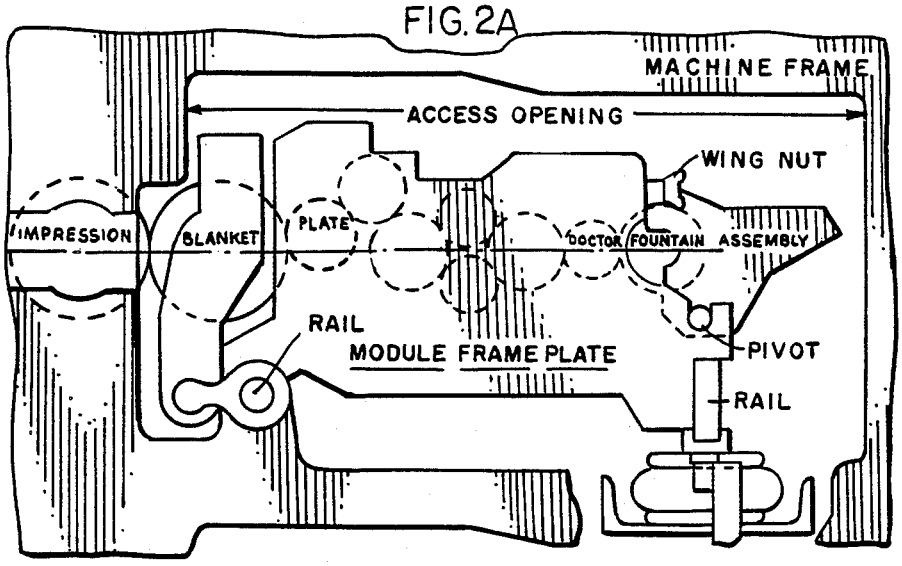
FIG. 2A is a considerably simplified version of FIG. 2 for illustrating the change necessary to change color.

A simplified version of FIG. 2 can be seen in FIG. 2A. To facilitate understanding of the various changes that can be made within a module, the reference numerals have been omitted and legends applied. In FIG. 2A it is seen that the access opening within the machine frame is sufficient to permit the module frame plate (and therefore the entire module) to be pulled laterally or sideways out of the machine along the elements designated "RAIL". This positions the module within the aisle for whatever change is indicated.

One change which is facilitated by this arrangement is the change of color which is brought about by replacing the fountain assembly. For this, the wing nut is loosened and the assembly rotated around the pivot so that the fountain roll can clear the frame whereupon a replacement assembly can be installed.

Figure 2B:
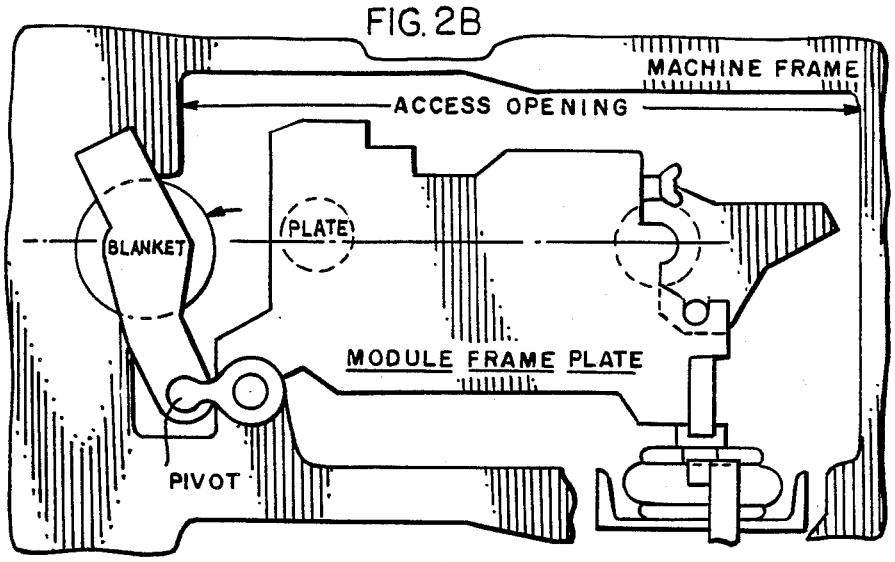
FIGS. 2B and 2C are views similar to FIG. 2A but showing that part of the module structure for changing the image or pattern being printed, and for changing repeat length.

FIG. 2B illustrates the arrangement again of FIG. 2A but shows with the module in the aisle beside the machine, the blanket roll assembly can be rotated about the pivot so as to afford access to the plate roll. With this arrangement, the plate on the plate roll can be readily changed.

Figure 2C:
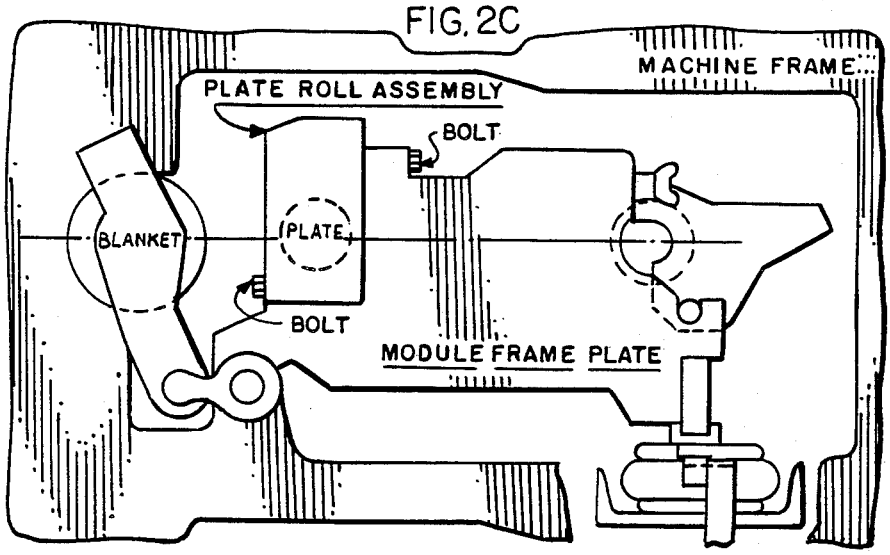

In FIG. 2C, the arrangement of elements is the same as it is in FIG. 2B, viz., the module being pulled into the aisle through the access opening and the blanket roll assembly pivoted away from the plate roll assembly, then, by removing the two items marked "BOLT", the entire plate roll assembly can be removed. Likewise, the blanket roll assembly can be removed and with the installation of different blanket and plate roll assemblies, the repeat length can be readily changed. The structural details responsible for the foregoing advantageous functions will now be described. In the same manner, different modules can be interchanged for individual web processing such as file hole punching, interior perforations, numbering, etc.

Structural Details

Figure 7:
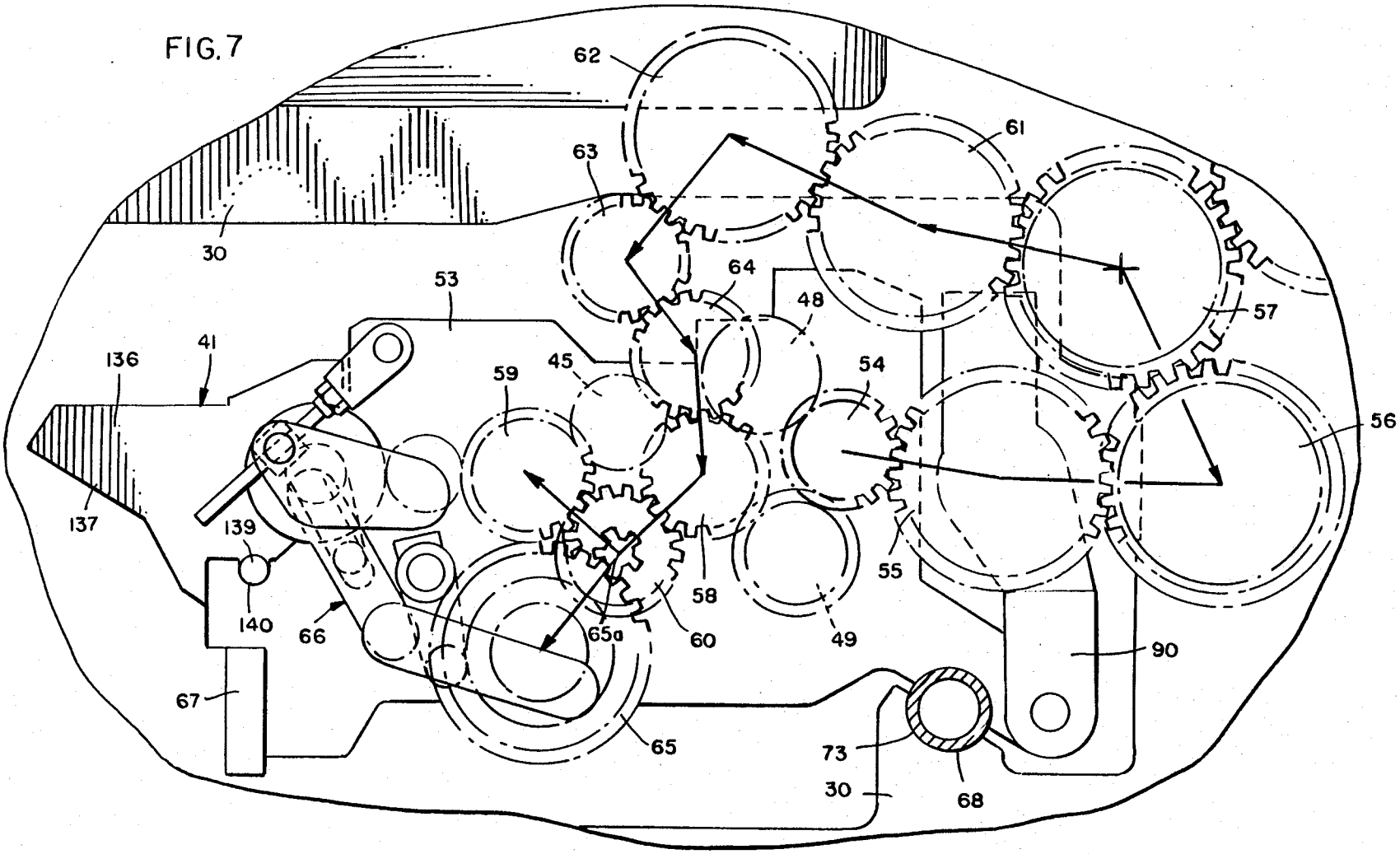
FIG. 7 is a fragmentary view of the rear of the module showing the drive gears.

The module 26 includes front and rear frame plates 52 and 53 (see also FIGS. 3 and 4) which are aligned with the front and rear plates 29 and 30 of the main frame. Each of the rolls 38 and 43–47 includes a shaft which is rotatably mounted in bearings in the front and rear frame plates 52 and 53. Referring to FIG. 7, driving gears 54, 55 and 56 are mounted on the shafts of the plate roll 38, blanket roll 39, and impression roll 40, respectively, and are driven by a gear 57 on the main frame. The various gear transmission trains are indicated by arrowed lines connecting the gear centers in FIG. 7. Gears 58 and 59 are mounted on the vibrator rolls 47 and 44, respectively, and gear 60 is mounted on the module frame. These gears are also driven by gear 57 through gears 61, 62, 63, and 64 on the main frame. The form rolls 48 and 49 and the distributor rolls 45 and 46 are driven by contact with the rotating vibrator rolls. The fountain roll assembly is driven by a large gear 65 which is driven by a small gear **65*a* on the same shaft as the gear 60. The gear 65 is connected to a conventional reduction drive assembly 66 which includes a crank linkage and an over running clutch. This provides a variable stroke intermittent ratchet drive to the fountain roll. Thus except for this optimal assembly, all module rolls are driven from a single source—the main frame gear 57. The ductor roll is driven by the fountain roll or the vibrator roll 44**, depending upon which roll it contacts. The Dahlgren wetting assembly is driven by its own DC motor (not shown).

Module Frame Support

Figure 3:
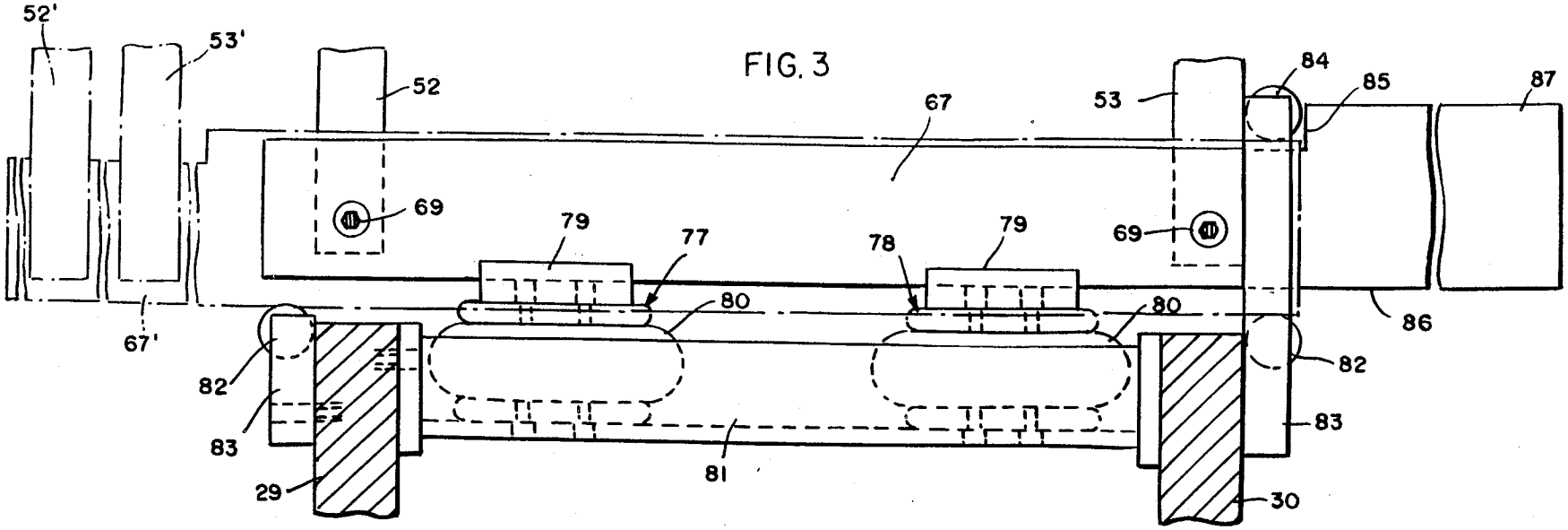
FIG. 3 is a fragmentary sectional view taken along the line 3—3 of FIG. 2.
Figure 4:
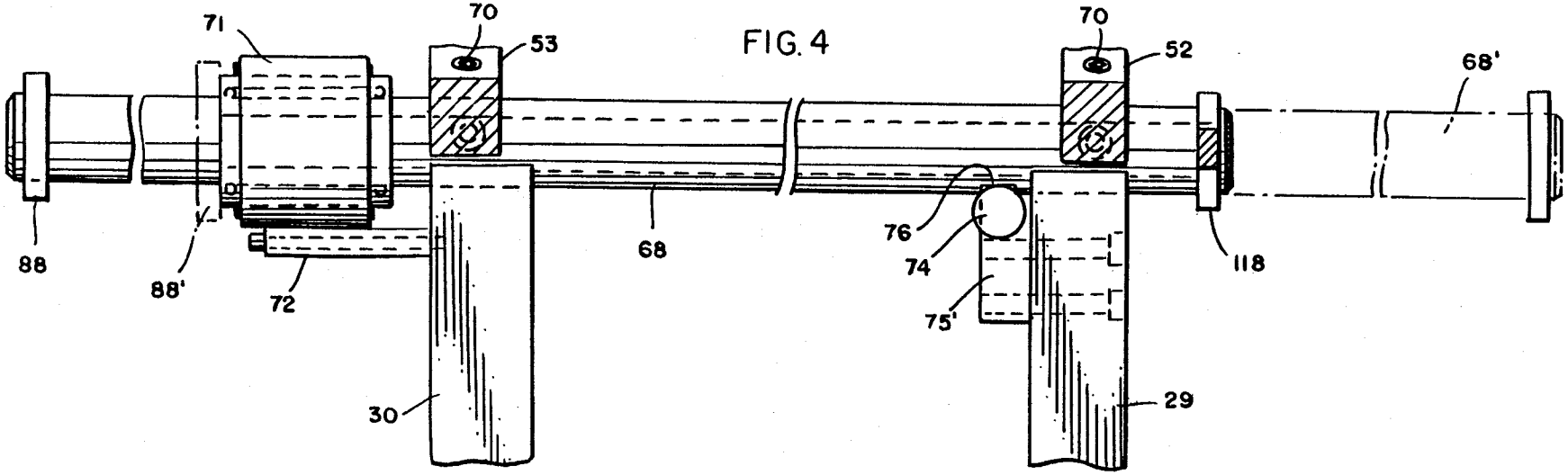
FIG. 4 is a fragmentary sectional view taken along the line 4—4 of FIG. 2.

The module frame plates 52 and 53 are supported by a pair of rails 67 and 68 which extend transversely between the plates (see also FIGS. 3 and 4 which are views taken from opposite directions as can be appreciated from the sight lines applied to FIG. 2). In FIGS. 2 and 3 the right rail 67 is seen to be a solid bar having a generally rectangular cross section and is bolted to the plates 52 and 53 by bolts 69. The left rail 68 (in FIGS. 2 and 4) is a tubular shaft which is bolted to the plates 52 and 53 by bolts 70.

The round rail 68 is supported for axial sliding movement by a bushing 71 (FIG. 4) which is mounted on the rear plate 30 of the main frame by a bracket 72, and each of the main frame plates 29 and 30 are provided with an arcuate recess or saddle 73 (FIGS. 2 and 7) which supports the rail in the position illustrated in solid in FIG. 4. A roller 74 is attached to the front main frame plate 29 by a bracket 75, and in the position illustrated in FIG. 4 the roller is positioned in a recess or flat 76 in the round rail so that the rail does not engage the roller.

The bar rail 67 is supported by a pair of air support assemblies 77 and 78 (FIGS. 2 and 3) which are mounted on the main frame. Each of the air support assemblies includes a channel 79 which engages the rail and an inflatable air bladder 80. A channel 81 extends between the main frame plates 29 and 30 and is secured thereto and supports the two air support assemblies. A pair of rollers 82 are attached to the two main frame plates below the rail by mounting brackets 83, and a roller 84 is mounted adjacent the rear module plate 53 above the rail.

Figure 8:
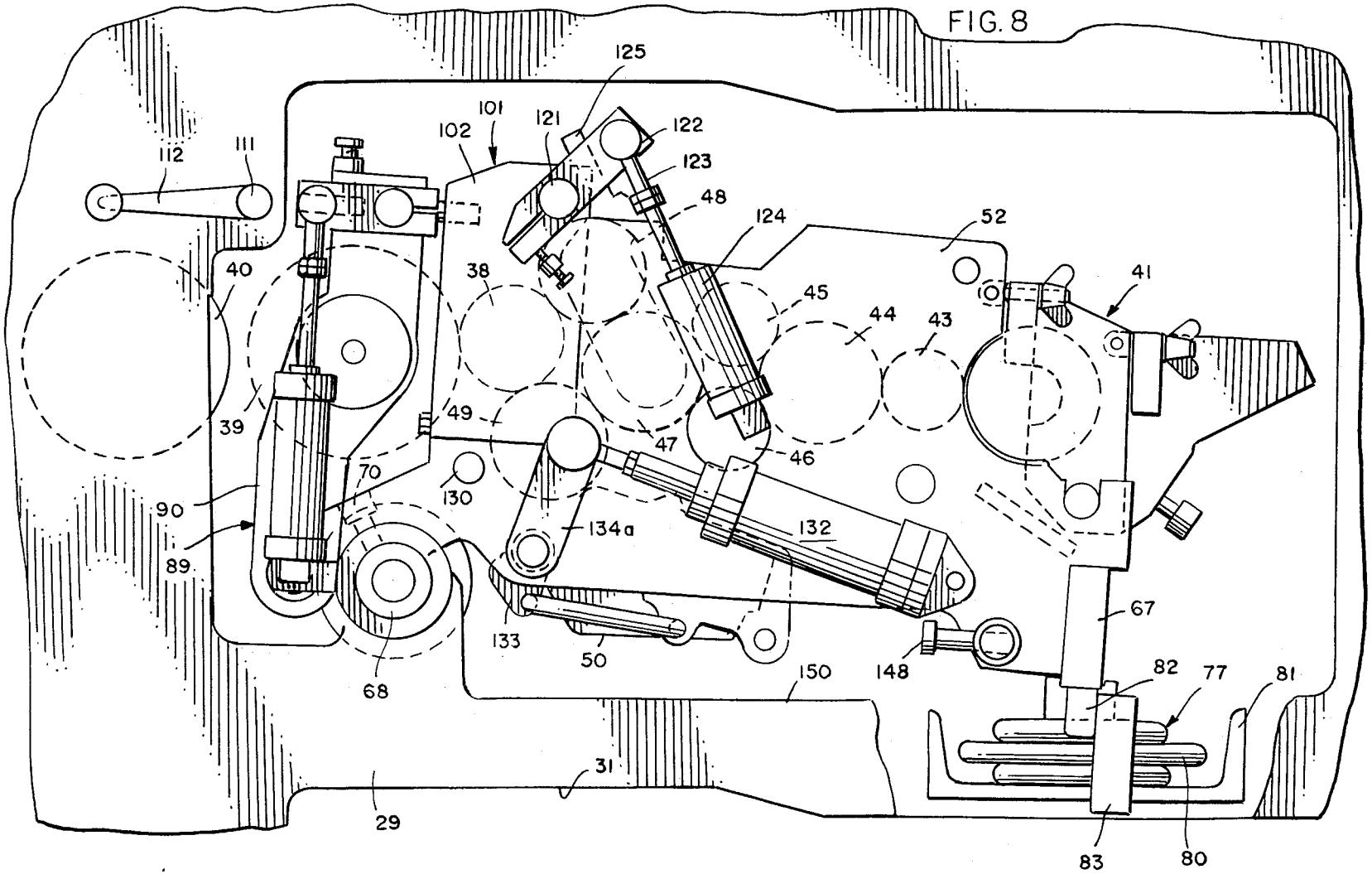
FIG. 8 is a view similar to FIG. 2 showing the module pivoted clockwise from its FIG. 2 position.

The air bladders 80 can be inflated and deflated by an air pump and valves (not shown). When the bladders are deflated, the entire module 26 pivots clockwise on the round rail 68 until the right rail 67 contacts the rollers 82 as shown in FIG. 8. The module can then be pulled forwardly through the opening 31 in the front of the main frame. A slight pull on the module will move the recess 76 in the round rail past the roller 74, and the round rail is thereafter slidably supported by the roller and the bushing 71.

Referring to FIGS. 3 and 4, each of the rails 67 and 68 has a length slightly more than twice the width (across the machine dimension) of the module and extends beyond the rear plate 30 of the main frame. The right rail 67 includes a shoulder 85 rearwardly of the roller 84, and when the lower edge 86 of the rail is supported by the rollers 82, the upper edge 87 rearwardly of the shoulder will contact the roller 84 as the rail moves forwardly to prevent the module from tripping. The round rail 68 is prevented from tipping by the circular support bushing 71 through which the rail slides.

Figure 5:
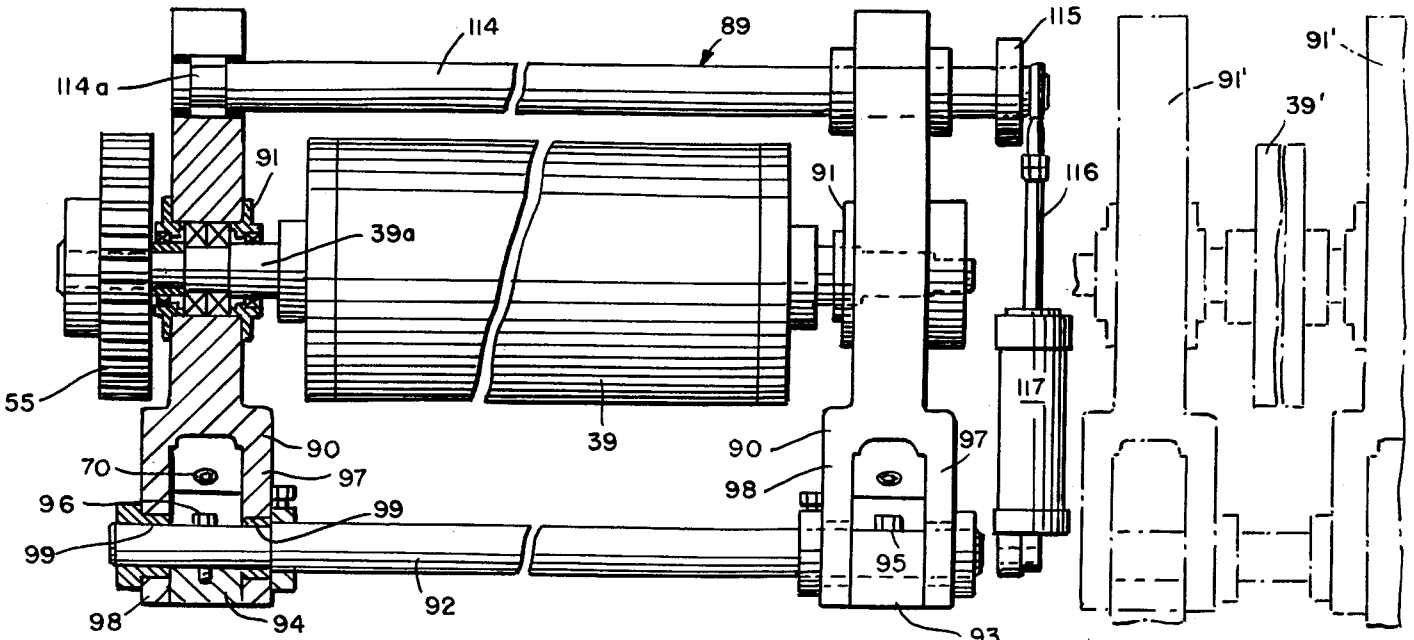
FIG. 5 is a fragmentary side elevational view of the blanket roll assembly taken along the line 5—5 of FIG. 2, one of the pivot arms being shown in cross-section.

The length of the rails is such that the module can be completely withdrawn from the main frame to a service position shown in phantom in FIGS. 3–5 and designated by primed reference numerals. In this position the parts of the module can conveniently be serviced or replaced, or the entire module can be replaced. The module can be replaced merely by removing the clamp collar 88 attached to the round rail 68 and pulling the module farther out beyond the service position. Then, the entire module can be lifted off the main frame saddles 73 and the support bars 79.

Blanket Roll Support

The blanket roll 39 is supported for pivoting movement away from the plate roll so that the blanket roll can be moved away from the plate roll when the module is in the service position. This provides access to the printing plate so that the printing plate can be changed quickly.

Referring to both FIGS. 2 and 5, the blanket roll is part of a blanket roll assembly generally designated 89 and which is pivotally supported by the left end of the module frame plates. The blanket roll assembly includes a pair of pivot arms 90 which carry bearings 91 for rotatably supporting the shaft 39*a* of the blanket roll. The pivot arms are pivotally mounted on the pivot shaft 92 which is supported by hook-shaped end portions 93 and 94 (see also FIG. 12) on the module frame plates 52 and 53, respectively. The pivot shaft 92 is secured to the hook portions by bolts 95 and 96 (see FIG. 5). Each pivot arm includes bifurcated end portions 97 and 98 which extend on either side of the hook portions of the module frame, and bushings 99 are mounted in the end portions to permit rotation of the pivot arms relative to the shaft. So the pivot shaft 92 is fixed (via bolts 95 and 96) relative to the machine frame, but rotatably related to the blanket roll assembly 89.

The blanket roll assembly 59 can be removed from the module by removing the bolts 95 and 96 which secure the shaft 92 to the module frame. By lifting the pivot arms 90 and the shaft 92 out of the hook shaped end portions 93 and 94 (see FIG. 5), the entire assembly 89 can be removed from the module frame 26.

Plate Roll Support

Figure 9:
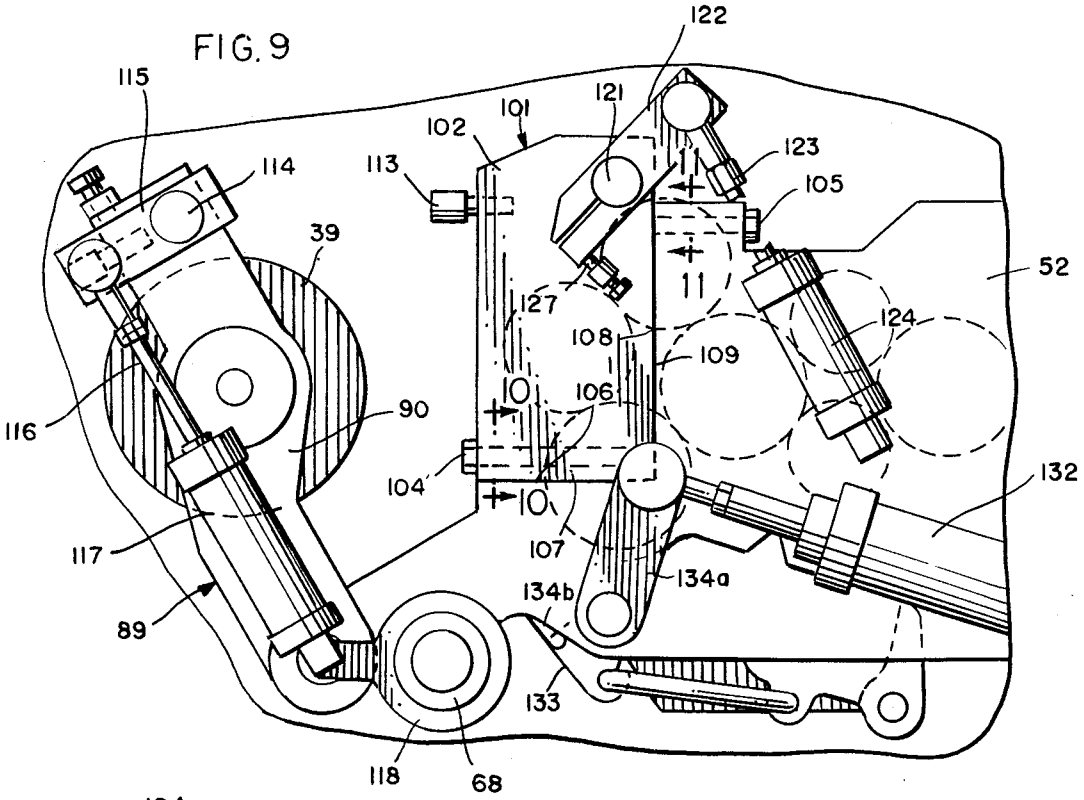
FIG. 9 is a fragmentary view similar to FIG. 8 showing the blanket roll assembly pivoted away from the plate roll after the module has been moved out of the main frame to its service position.
Figure 11:
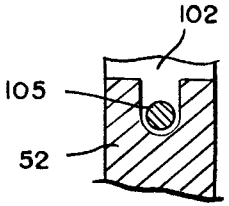
FIG. 11 is a fragmentary sectional view taken along the line 11—11 of FIG. 9.
Figure 10:
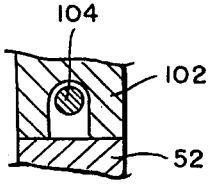
FIG. 10 is a fragmentary sectional view taken along the line 10—10 of FIG. 9.

The plate roll 38 is part of a plate roll assembly 101 (see also FIGS. 8 and 9) which is removably attached to the module frame plates 52 and 53. The plate roll assembly includes a pair of end plates 102 and 103 (FIGS. 6 and 8) which are aligned with the module frame plates secured thereto by bolts 104 and 105 (FIGS. 9–11). The bottom edge 106 of the end plate 102 is supported by a horizontal edge portion 107 of the module frame plate 52 (see FIG. 9), and the right edge 108 of the end plate 102 abuts a vertical edge portion 109 of the module frame plate 52. Referring to FIG. 10, the bottom portion of the end plate 102 through which the bolt 104 extends is channel-shaped, and referring to FIG. 11, the portion of the module frame plate 52 through which bolt 105 extends is also channel-shaped. The other end plate 103 is similarly formed and supported.

Figure 12:
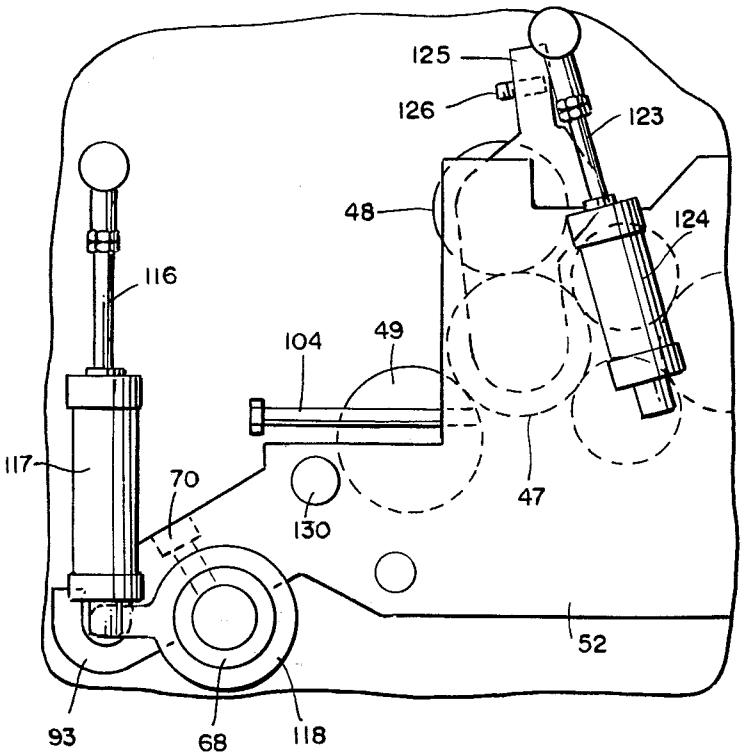
FIG. 12 is a fragmentary view similar to FIG. 9 showing the blanket roll assembly and the plate roll assembly removed from the module.

After the blanket roll assembly is removed from the module, the plate roll assembly can be removed merely by loosening the bolts 104 and 105 and lifting the assembly. The bolts 104 remain in the module frame 52 as seen in FIG. 12, and the bolts 105 remain in the plate roll assembly.

Impression-Blanket Roll Nip Adjustment

When the module is in the operating position shown in FIG. 2, the air support assemblies 77 and 78 support the right side of the module and hold the blanket roll 39 adjacent the right side of the module and hold the blanket roll 39 adjacent the impression roll 40 to form the nip for the web 32. The position of the blanket roll 39 relative to the impression roll 40 is controlled by a pair of stop horizontally extending bolts 110 (see the upper left portion of FIG. 2). These bolts 110 are threaded into the upper ends of the pivot arms 90 of the blanket roll assembly (see also FIG. 6). The stop bolts 110 engage an eccentric shaft 111 in the main frame to limit the counterclockwise movement of the module under the influence of the air support assemblies. The eccentric shaft extends between the main frame plates 29 and 30, and the end portions of the shaft 111 are rotatably supported in the frame plates. The shaft is cylindrical except for the portions 111*a* thereof which are engageable with the stop bolts 110, the portions 111*a* being eccentrically formed. The eccentric portions are exposed by openings 29*a* and 30*a* (FIG. 6) in the main frame plates for engagement by the stop bolts, and minor adjustments (fine "tuning") to the blanket-to-impression nip can be made by rotating the eccentric shaft by a crank arm 112 mounted thereon. Greater adjustment (coarse "tuning") to the nip can be made by turning the stop bolts 110 into or out of their threaded openings in the pivot arms 90.

Blanket-Plate Roll Nip Adjustment

The nip between the plate roll 38 and the blanket roll 39 is controlled by stop bolts 113 threaded into the end plates of the plate roll assembly and an eccentric shaft 114 (see also FIGS. 5 and 6) which extends between the pivot arms 90 of the blanket roll assembly. The eccentric shaft 114 is rotatably supported by the pivot arms 90 and the portions 114*a* (FIG. 6) of the shaft 114 which are engaged by the stop bolts are eccentrically formed—much the same as with the "fine tuning" eccentric portions 111*a* of the web nip adjusting eccentric shaft 111.

A crank arm 115 is secured to the aisle-side end of the eccentric shaft 114 (see FIG. 5), and the piston rod 116 of an air cylinder 117 is pivotally connected to the crank arm 115 for rotating the eccentric shaft 114 to adjust the plate-to-blanket nip. Thus, minor adjustment in the plate-to-blanket nip (fine "tuning") can be made by the air cylinder, and greater adjustment can be made by manually turning the stop bolts 113. The air cylinder is also used to establish the plate-to-blanket nip automatically after a few rotations of the plate roll. In lithographic printing the plate roll should rotate several times before it is brought into contact with the blanket roll, and the air cylinder can be actuated when desired in order to rotate the eccentric shaft and establish the plate-to-blanket nip.

The bottom of the air cylinder 117 is supported by an eye bracket 118 (FIGS. 2, 9 and 12) which encircles the round rail 68. Thus, the air cylinder 117 is fixed to the rail 68 and also fixed to the aisle-side pivot arm 90. When the blanket roll assembly 89 is to be removed from the module, the piston rod 116 is first disconnected from the crank arm 115—hence the aisle-side pivot arm 90. The air cylinder 117 therefore remains attached to the module 26 when the blanket roll assembly 89 is removed.

Plate-Ink Form Roll Nip Adjustment

The nip between the ink form roll 48 and the plate roll 38 can be adjusted by an eccentric shaft 121 (FIGS. 2, 8 and 9) which is rotatably supported by the end plates 102 and 103 of the plate roll assembly. A crank arm 122 is secured to the eccentric shaft outside of the aisle-side or front module frame plate 52, and the piston rod 123 of an air cylinder 124 is pivotally connected to the crank arm 122 for rotating the eccentric shaft 121. The air cylinder 124 is pivotally mounted on the outside of the module frame plate 52 and is disconnected from the crank arm 122 when the plate roll assembly 101 is to be removed from the module 26.

In FIG. 2, the ink form roll 48 is seen to be rotatably supported by a pair of arms 125 (see also FIG. 12) which are pivotally mounted on the shaft of the vibrator roll 47. An adjustable stop screw 126 is mounted in each of the arms 125 and is engageable with the eccentric shaft 121. The portions of the eccentric shaft which are engageable with the stop screws 126 are eccentrically formed, and the rotation of the eccentric shaft 121 by the air cylinder 124 moves the ink form roll 48 toward and away from the plate roll 37. An adjustable stop screw 127 (FIG. 9) mounted on the outside of the end plate 102 of the plate roll assembly is engageable with the crank arm 122 to limit excessive rotation of the eccentric shaft 121.

Plate-Wet Form Roll Nip Adjustment

The nip between the wet form roll 49 and the plate roll 38 can be adjusted by an eccentric shaft 130 which is rotatably supported by the module frame plates 52 and 53 (see also FIG. 12). The wet form roll 49 is rotatably supported by a pair of arms 131 which are pivotally mounted on the shaft of the vibrator roll 47, and the arms 131 can be pivoted toward and away from the eccentric shaft 130 by an air cylinder 132 which is included as part of the Dahlgren wetting assembly 50. The air cylinder 132 is mounted on the outside of module frame plate 52 and is connected to the pivot arm 131 by a bell crank 133 and links 134*a* and 134*b*. Adjustable stop screws 130 for adjusting the nip between the wet form roll and the plate roll.

The air cylinder 124 for the ink form roll and the air cylinder 132 of the Dahlgren assembly are operated by a conventional timing circuit. When the printing press is started, the timing circuit operates the air cylinder 132 to move the wet form roll against the plate roll before the air cylinder 124 rotates the eccentric shaft 121 to move the ink form roll against the plate roll. Conversely, when the press is shut off, the air cylinder 124 is operated first to disengage the ink form roll from the palte roll before the air cylinder 132 disengages the wet form roll from the plate roll.

Referring to FIGS. 2 and 7, the ink fountain assembly 41 includes a frame having front and rear plates 135 and 136 which rotatably support the fountain roll 42, an end plate 137, and a bottom plate 138 which provide an ink fountain or reservoir. A pair of pivot pins 139 extend transversely outwardly from the front and rear plates 135 and 136, and each of the pivot pins is rotatably supported in a U-shaped recess 140 in the front and rear module frame plates 52 and 53.

The fountain assembly is retained in the position illustrated in FIG. 2 by a wing nut 141 which is threadedly engaged with a bolt 142 and which engages bracket 143 on the fountain assembly. The bolt 142 is pivotally connected to the module frame plate 52 by a pin 144 and extends through a U-shaped recess in the bracket 143. When the wing nut 141 is loosened, the bolt 142 can be pivoted upwardly, and the fountain assembly can then be pivoted clockwise to permit the fountain roll to swing away from the module frame plates. When the fountain roll clears the frame plates, the fountain assembly can be lifted away from the module for replacement. A second wing nut 145 permits just the right side portion of the fountain to be opened for cleaning the fountain without removing the entire fountain assembly from the module.

Still referring to FIG. 2, the centers of the impression roll 40, blanket roll 39, vibrator rolls 47 and 44, ductor roll 43 and fountain roll 42 all lie on a common horizontal center line designated by the letter "A". The center of the particular plate roll shown in FIG. 2 is slightly above the center line, and the two form rolls 48 and 49 lie respectively above and below the center line—as also do the distributor rolls 45 and 46. Accordingly, the rolls of the printing press are arranged substantially horizontally, and the height of the module is thereby minimized. This permits three modules to be stacked in each of the towers 21–24 of FIGS. 1 and 1A without causing the height of the towers to be excessive. The compact arrangement of the rolls also permits the horizontal dimensions of the modules and the towers to be maintained within tolerable limits, and the overall horizontal dimension of the four towers is not excessive even though the towers are spaced apart horizontally to provide access spaces 147 (FIG. 1A) between the towers. In one specific embodiment of the invention, the vertical dimension of each tower was 68 inches (1.7 meters), the horizontal dimension of each tower was 40 inches (1.0 meters), and a 20 inch (0.5 meters) access space was provided between each pair of adjacent towers. Three processing operations could therefore be performed on each of four webs within a total horizontal length of 220 inches (5.6 meters) and a vertical height of 68 inches (1.7 meters). Aleternatively, a single web could be passed through each of the four towers so that twelve operations could be performed on a single web. For example, it might be desired to print one face of the web with twelve colors or to print both the front and back of the web with a total of twelve colors.

Operation

Web Threading

As can be seen from FIGS. 1A and 2, the web passes vertically through each of the nips between the blanket rolls 39 and the impression rolls 40. Accordingly, the web can be quickly threaded through each of the three modules of each tower simply by pushing the web upwardly through the nip. In order to facilitate web threading, each module can be rotated clockwise slightly on the round rail 68 by deflating the air support assemblies 77 and 78 enough to open the blanket-to-impression nips but not enough to disengage the drive gears on the impression and blanket rolls. Referring to the lower right portion of teh module of FIG. 2, a stop bolt 148 is attached to a rotatable shaft 149 which extends between the module frame plates 52 and 53. As the air support assemblies are deflated, the stop bolt 148 is engageable with a built-up portion of the edge 150 of the main frame plate 29 to limit further rotation of the module. The stop bolt 148 permits just enough rotation of the module to open the blanket-to-impression nip without disengaging the gears on the impression and blanket rolls.

If it is desired to rotate the module sufficiently to disengage the drive gears on the impression and blanket rolls, the shaft 149 is rotated clockwise to move the stop bolt 148 out of position, thereby allowing the rail 67 to contact the rollers 82 when the air supports are deflated as shown in FIG. 8. This positions the module in a disengaged position in which it may be pulled forwardly on the rails 67 and 68 to the service position.

Plate Change

When the printing plate on the plate roll is to be changed, the air support assemblies 77 and 78 are deflated to pivot the module clockwise until the right rail 67 engages the rollers 82. In this position the drive gears of the impression roll 40 and blanket roll 39 will be disengaged, and the module can be pulled out of the main frame on the rails 67 and 68 into the aisle. When the module is in its service position outside of the main frame, the blanket roll assembly 89 can be pivoted away from the plate roll on the pivot shaft 92 to provide access to the printing plate as shown in FIG. 9. Pivoting the blanket roll 39 away from the plate roll 38 disengages the drive gears 55, 54 on these rolls, and since the ink form roll and the wet form roll do not contact the printing plates when the press is off, the plate roll can be rotated freely to facilitate changing the printing plate.

After the plate has been changed, the blanket roll assembly 89 can be pivoted back to its original position, and the module can be pushed back into the main frame on the rails 67 and 68. When the air support assemblies 77 and 78 are inflated to pivot the module back to its operating position, the plate-to-blanket roll nip and the blanket-to-impression roll nip are automatically reestablished by the engagement of the stop bolts 113 with the eccentric shaft 114 and the engagement of the stop bolts 110 with the eccentric shaft 111. If any adjustment of these nips is needed, this can be accomplished by rotating the eccentric shafts 111 or 114. If any adjustments of the nips between the ink form roll and the plate roll and between the wet form roll and the plate roll is needed, this can be accomplished by adjusting the stop bolts 124 and 131*a* which engage the eccentric shafts 121 and 130, respectively.

Since considerable access to the printing plate is provided by pivoting the blanket roll assembly away from the plate roll, and since the nips between the plate and blanket rolls and between the blanket and impression rolls are automatically reestablished by inflating the air support assemblies, the printing plate can be easily changed in a matter of minutes, thereby minimizing the downtime of the machine.

Ink Color Change

If the color of the ink is to be changed, the entire ink fountain assembly 41 can be removed from the module merely by loosening the wing nut 141. A new ink fountain assembly with the desired color ink can then be mounted on the module.

Changing the Repeat Length

The repeat of the printing press can also be changed readily by replacing the blanket roll assembly 89 and the plate roll assembly 101. The module is first moved to its service position by deflating the air support assemblies 77 and 78 and pulling the module out of the main frame on the rails 67, 68. The blanket roll assembly 89 is removed by removing the bolts 95 and 96 which secure the pivot shaft 92 to the module frame and disconnecting the piston rod 116 from the crank arm 115. After the blanket roll assembly is removed, the plate roll assembly 101 can be removed by loosening the bolts 104 and 105 and by disconnecting the piston rod 123 from the crank arm 122 (compare FIGS. 8 and 12).

The plate roll assembly and the blanket roll assembly are replaced with different assemblies which are substantially the same as the original assemblies except that the diameters of the plate and blanket roll are different, and the mounting position of the plate roll in the end plates of the plate roll assembly and the mounting position of the blanket roll in the pivot arms are different to accommodate the change in diameters of these rolls.

The plate roll 38 as illustrated in FIG. 2 has a circumference of 8½ inches and, therefore, a repeat of 8½ inches (21.6 cm). The circumference of the blanket roll 39 is 17 inches (43.2 cm—two times 8½ inches repeat of the plate roll). Since the horizontal dimension between the center of the imperssion roll 40 and the center of the vibrator roll 47 is fixed (about 12.8 inches or 32.5 cm in the embodiment shown in FIG. 2), if the diameter of the plate roll is changed, the diameter of the blanket roll 39 must also be changed.

FIG. 12 illustrates the module after the blanket roll assembly 89 and the plate roll assembly 101 have been removed. Comparing FIGS. 8 and 12, it will be seen that the crank arm 122 which is mounted on the eccentric shaft 121 is part of the plate roll assembly and is removed with the plate roll assembly after detaching the crank arm from the piston rod 123. The ink form roll 48 is mounted on the pivot arms 125 which pivot about the shaft of the vibrator roll 47, and the ink form roll is pivoted clockwise in FIG. 12 to permit the plate roll assembly to be removed.

Figure 13:
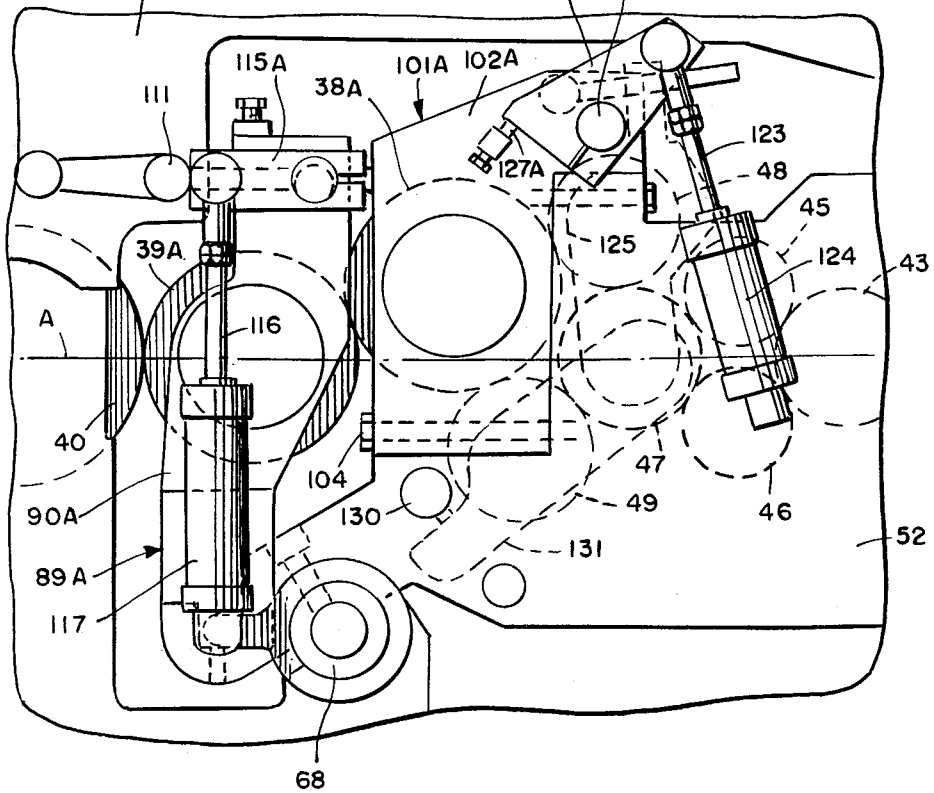
FIG. 13 is a fragmentary view similar to FIG. 2 showing a different blanket roll assembly and plate roll assembly mounted on the module to change the repeat of the module.

FIG. 13 illustrates the printing module with a new blanket roll assembly 89A and a new plate roll assembly 101A. The new plate roll 38A has a circumference or repeat of 14 inches (35.6 cm), and the new blanket roll 39A has a circumference of 14 inches. Except for the smaller blanket roll 39A, the blanket roll assembly 89A is identical to the blanket roll assembly 89, and like parts on the two blanket roll assemblies are numbered the same with the addition of the lettter A.

The center of the 14 inch blanket roll 39A is on the center line A, and the center of the 14 inch (35.6 cm) plate roll 38A is positioned slightly higher from the center line than was the center of the 8½ inch (21.6 cm) repeat roll 38 (1½ inches (3.8 cm) compared to about ⅝ inch—1.6 cm) in order to accommodate the greater overall dimensions of the plate roll 38A and the blanket roll 39A between the fixed positions of the impression roll 40, the vibrator roll 47, and the wet form roll 49. The wet form roll 49 is maintained at a fixed position after each repeat change so that the Dahlgren adjustments are not affected by the repeat change. The ink form roll 48 is swung into contact with the plate roll 38A on the pivot arms 125. Since the plate roll 38A has a greater diameter than the plate roll 38, the included angle between the center of the vibrator roll 47 and the centers of the form rolls 48 and 49 is greater in FIG. 13 than in FIG. 8.

An eccentric shaft 112A is rotatably supported by two end plates of the plate roll assembly 101A, and a crank arm 122A is pivotally connected to the piston rod 123 of the air cylinder 124. The stop pins 126 carried by the two pivot arms 125 engage the eccentric shaft 121A, and the nip between the ink form roll 48 and the plate roll 38A is adjusted by rotation of the crank arm 122A.

Figure 14:
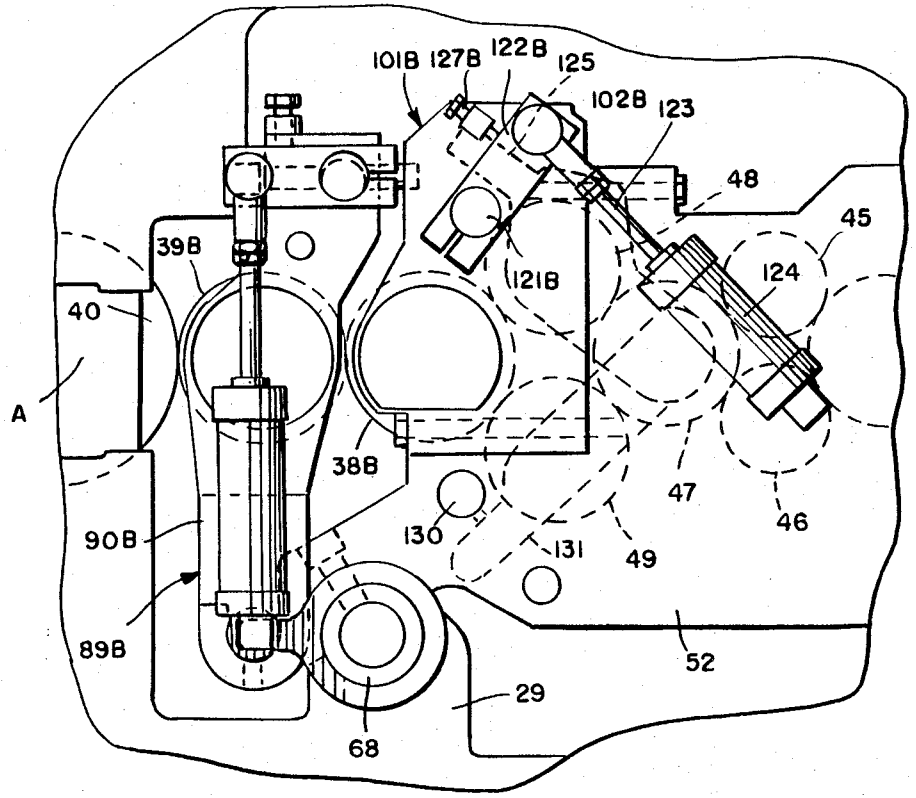
FIG. 14 is a fragmentary view similar to FIG. 13 showing another blanket roll assembly and plate roll assembly mounted on the module to change the repeat of the module.

FIG. 14 illustrates the module with a plate roll assembly 101B and a blanket roll assembly 89B for providing an 11 inch (27.9 cm) repeat. The circumference of the plate roll 38B is 11 inches, and the circumference of the blanket roll 39B is also 11 inches. The center of the blanket roll 39B is on the center line A, and the center of the plate roll 38B is on the center line. The ink form roll 48 is moved into contact with the plate roll 38B on the pivot arms 125, and the stop bolts on the pivot arms 125 engage an eccentric shaft 121B which extends through the end plates of the plate roll assembly. The crank arm 122B is connected to the piston 123.

Each different size plate roll is advantageously mounted in its own set of end plates 102 and 103, and each different size blanket roll is likewise mounted in its own pivot arms 90. Accordingly, when the repeat is to be changed, the entire plate roll assembly 101 is replaced with a different plate roll assembly which includes the plate roll having the desired repeat, and the entire blanket roll assembly is replaced with the blanket roll assembly having the blanket roll which is intended for use with the desired plate roll. Since the plate roll and blanket roll assemblies can be removed and replaced merely by loosening a few bolts, the repeat of the machine can be changed in a very short time.

Other plate roll assemblies and blanket roll assemblies have been made for providing the printing module with repeats of 8 inches (20.3 cm), 12 inches (30.5 cm), and 13 inches (33.0). The plate roll assemblies for these repeats have plate rolls with above-designated dimensions as circumferences, viz., 8, 12 and 13 inches, respectively, and the blanket roll assemblies have blanket rolls with circumferences of 16 (40.6 cm), 12 (30.5 cm), and 13 (33.0 cm) inches, respectively. Any repeat between 8 (20.3 cm) and 14 (35.6 cm) inches can be provided by varying the circumferences of the plate roll and blanket roll and positioning the center of the plate roll to accommodate the difference in the sizes of the plate and blanket rolls. Although plate roll circumferences of 8 (20.3 cm) inches and 8½ inches (21.6 cm) are shown in the drawings, this invention also contemplates the use of plate and blanket rolls having a circumference equal to an integral number of repeats.

Figure 15:
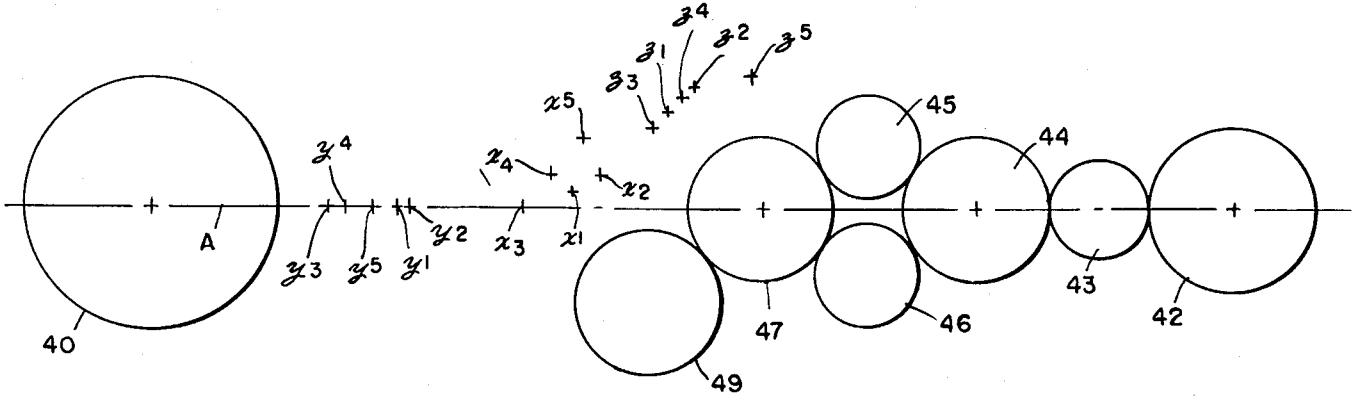
FIG. 15 is a fragmentary view showing the fixed positions of the rolls which do not move when the repeat is changed and the variable positions of the blanket roll, plate roll, and ink form roll for various repeats.

FIG. 15 illustrates the center positions, designated $x_1$ through $x_5$, of plate rolls having circumferences of 8, 8½, 11, 12 and 14 inches, the center positions, designated $y_1$ through 25, of the corresponding blanket rolls having circumferences of 16, 17, 11, 12 and 14 inches and the center positions which the ink form roll 48 occupies for each repeat, designated $z_1$ through $z_5$. The following table correlates these positions with the plate circumference.

| Plate Circumference | | Plate | Blanket | Blanket | Ink Form Roll |
|---|---|---|---|---|---|
| Inches | cm | Position | Circumference | Position | Position |
| 8 | 20.3 | $x_1$ | 16 | $y_1$ | $z_1$ |
| 8½ | 21.6 | $x_2$ | 17 | $y_2$ | $z_2$ |
| 11 | 27.9 | $x_2$ | 11 | $y_3$ | $z_3$ |
| 12 | 30.5 | $x_4$ | 12 | $y_4$ | $z_4$ |
| 14 | 35.6 | $x_5$ | 14 | $y_5$ | $z_5$ |

In the prior method, the arrangement of the plate, blanket and impression rolls in relation to the ink train from the fountain normally occupied a fixed distance, the accommodation for different repeats being achieved through pivoting the blanket roll around the plate roll center. The instant invention represents a substantial change in concept because the overall dimension between the fountain and the impression roll is maintained constant by providing means for pivoting the entire assembly including the blanket roll about the rail 68. The blanket roll 39 can also be pivoted independently about shaft 92 for changing plates, but it is the combination of pivoting about the shaft 92 and the replaceable roll assembly that makes the printing module so readily changeable. When new rolls are placed back into the machine, the position of the impression roll and the distance between impression to fountain is maintained. More particularly, the replaceable "sub-module" or side frame members of the plate roll assembly are drilled with prelocated holes, the location of these holes for each particular side frame are shown in FIG. 15 by the designations $x_1$, $x_2$, etc.

Figure 16:
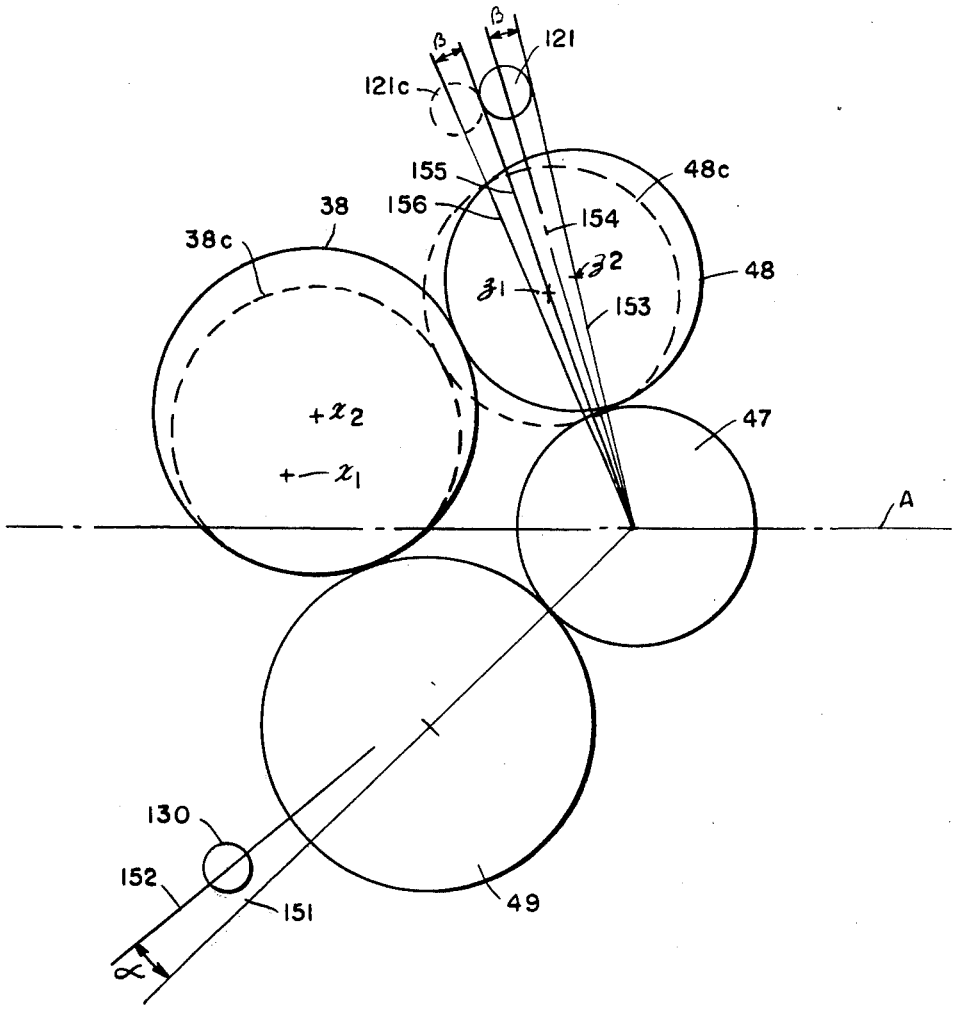
FIG. 16 is a fragmentary view showing the relative positions of the plate roll and ink form roll for two repeats.

As stated previously, the center of the wet form roll 49 is maintained fixed for each repeat so that the Dahlgren adjustments are not affected. Referring to FIG. 16, the angle $\alpha$ between a line 151 through the centers of the vibrator roll 47 and the wet form roll 49 and a line 152 through the centers of the vibrator roll 47 and the eccentric shaft 130 is desirably maintained constant so that the adjusting screw **131*a*** which engages the eccentric does not have to be adjusted.

The eccentric shaft 121 of each of the plate roll assemblies is positioned in the end plates of the assembly so that the adjusting screws 126 on the pivot arms 125 which carry the ink form roll do not have to be adjusted. Referring again to FIG. 16, a line 153 through the center of the vibrator roll 47 and the center $z_2$ of the ink form roll 48 when the form roll engages an 8½ inch circumference plate roll forms an angle $\beta$ with a line 154 through the centers of the vibrator roll and the eccentric shaft 121 of the plate roll assembly 101. When an 8 inch plate roll 38C is used the center of the ink form roll will shift to the position designated $z_1$, and the new position of the form roll is designated **48*c*. The eccentric shaft 121*c* of the plate roll assembly for the 8 inch circumference plate roll will be positioned so that the angle $\beta$ is maintained between the lines 155 and 156 drawn through the centers of the form roll 48*c* and the eccentric shaft 121*c***.

Although the printing module described herein is a dry offset printing press, it will be understood that the invention can also be used with other types of printing such as wet offset (lithographic), flexographic, rotogravure, etc., by changing modules. A common problem in offset printing arises from the fact that the plate roll is "buried" with the machine behind the blanket roll, and changing the printing plate or the repeat is often a difficult and time-consuming operation. The invention permits these changes to be made quickly and easily and minimizes the down-time required for the changeover.

Further, although the specific module described herein is an offset printing press, other types of modules can be mounted on the rails 67 and 68 depending on the operations which are to be performed on the web. For example, modules can be used which will perform operations such as punching, perforating, slitting, direct printing, etc. In each case, the roll of the module (i.e., the "module" roll) which corresponds to the blanket roll 39 of the offset printing press module and the roll in the main frame (i.e., the "tower" roll) which corresponds to the impression roll will be designated to perform the desired operation. For example, in a module for slitting the web, the module roll (corresponding to the blanket roll 39) will be equipped with slitting knives, and the tower roll (corresponding to the impression roll 40) will be provided with recesses to accommodate the slitting knives.

Each of the different types of modules will be supported on the rails 67 and 68 and air support assemblies 75 and 76. Each module can be quickly replaced merely be deflating the air support assemblies, moving the module on the rails into its service position, removing the stop collar 88 on the round rail and removing the modules with rails attached.

The foregoing represents essentially a change in concept or approach in arranging and operating business forms machinery. Historically such machines have had a "multi-web" section (as in the left hand portion of FIG. 1 and an individual section, viz., FIG. 1A. This separation now need not be maintained for all business form characteristics to be imparted to a web or webs but rather the imparting of the characteristics is performed at the selection of the operator for optimum performance. Alternatively, the invention can be viewed as providing the operator the opportunity for maximum flexibility of operation, irrespective of the form being developed: (1) standard body forms, (2) limited customs forms, or (3) specialized forms. For example, the invention provides 13 different features which apply to the 3 above categories as follows:

Standard Body Forms

The machine features that are important for rapid changeover, etc., and as they apply to Standard Body Forms are:

(1) Each spaced apart tower is constructed of "building block" modules which includes the frame and the removable module portion. Additional modules (processing steps) can be added without changes to the drive components between towers.

(2) With turning bars between modules subsequent printing steps in the tower are completed on the opposite side of the web.

(3) The arrangement permits blanket and plate roll assemblies to be changed without affecting changes in the balance of the printing train. This accommodates cylinder diameter combinations that define any repeat length from eight inches through 14 inches in increments of either $\frac{1}{3}''$ or $\frac{1}{4}''$.

(4) Using the air release and sub-frame arrangement above, the blanket roll and plate roll assemblies are accessible and readily changeable by removing each roll assembly and substituting an assembly for a different repeat length, each assembly including rolls, gearing, bearings and bearing housing.

(5) All rolls on the printing side are pivotally mounted so that air release disengages the gearing, allows the printing train to be moved outside of the frame, and by releasing a subportion of the printing train, all other rolls in the train back away from the plate cylinder, thereby leaving it accessible and free to rotate for plate change.

(6) The mounting arrangement permits the printing module to be pulled out to the servicing aisle and then a portion of the ink fountain can be removed for cleaning, or the complete fountain assembly can be interchanged for a rapid color change.

(7) Any printing characteristic can be selectively engaged or disengaged with the module in place.

(8) The printing modules are pivotally arranged to control the nip pressure between the blanket and impression cylinder. This compensates for different caliper of web.

Limited Customs Forms (9) The removable portion of the module can be a printing unit which is substantially horizontal and is completely interchangeable with module portions of any other specification.

(10) A plurality of webs can be handled and each web can have a different number of characteristics without any affect on the ability to combine and process superposed webs later on.

(11) By using turning bars between modules and towers, the last of two printing specs and all printing specs thereafter can be performed on the opposite side, for example: The printing spec mix could be (first side—second side): 1-5, 2-4, 3-3, 4-2 or 5-1.

Specialized Forms

(12) The arrangement does not limit the number of characteristics that can be put on any one web, i.e., print, perforate, numbering, etc.

(13) The tower arrangement permits processing steps on any web to be created in more than one tower, for example, Item 11 above shows a total of six printing specs on one web, however, these six processing steps can be any characteristic required on the business form.

While in the foregoing specification, a detailed description of the specific embodiments of our invention was set forth for the purpose of illustration, it will be understood that many of the details herein given may be varied considerably by those skilled in the art without departing from the spirit and scope of the invention.

We claim:

1. In a paper web processing machine having a tower frame and a tower roll rotatably mounted in the tower frame, a module removably mounted in the tower frame, the module comprising:

a module frame, a module roll rotatably supported by the module frame and having an axis of rotation parallel to the axis of rotation of said tower roll, first and second rail means supporting the module and being supported by the tower frame for permitting the module to be slidably, axially moved out of the tower frame on the rail means to a service position, the module being pivotable on the first rail means between a first position in which the module roll is positioned adjacent the tower roll to provide a nip for a paper web between the rolls and a second position in which the module roll is spaced from the tower roll and in which the module can be slidably moved out of the tower frame on the first and second rail means, and module support means on the tower frame for moving the module between said first and second positions.

2. The structure of claim 1 including nip-adjusting means on the tower frame and the module for pivoting the module roll relative to the tower frame when the module is in its first position for adjusting said nip.

3. The structure of claim 1 in which the first rail means includes a cylindrical shaft rotatably supported by the tower frame, the module frame being secured to the shaft for rotation therewith whereby the module can move between its first and second positions, and bearing means supporting the shaft for axial sliding movement.

4. The structure of claim 1 in which the second rail means includes a rail secured to the module frame and rollers on the tower frame engageable with the rail when the module is in its second position.

5. The structure of claim 1 including an eccentric rotatably mounted on one of the tower frame and the module and a stop member on the other of the tower frame and the module, the stop member engaging the eccentric when the module is in its first position to provide said nip whereby the nip can be adjusted by rotating the eccentric.

6. The structure of claim 1 in which the first rail means includes a cylindrical shaft rotatably supported by the tower frame, the module frame being secured to the shaft for rotation therewith whereby the module can move between its first and second positions, and bearing means supporting the shaft for axial sliding movement, the second rail means including a rail secured to the module frame and rollers on the tower frame engagable with the rail when the module is in its second position.

7. In a paper web processing machine having a tower frame and tower roll rotatably mounted in the tower frame, a module removably mounted in the tower frame, the module comprising:

a module frame, a module roll rotatably supported by the module frame, first and second rail means supporting the module and being supported by the tower frame for permitting the module to be slidably moved out of the tower frame on the rail means to a service position, the module being pivotably on the first rail means between a first position in which the module roll is positioned adjacent the tower roll to provide a nip for a paper web between the rolls and a second position in which the module roll is spaced from the tower roll and in which the module can be slidably moved out of the tower frame on the first and second rail means, and module support means on the tower frame for moving the module between said first and second positions, a pair of pivot arms pivotally mounted on the module frame, the module roll being rotatably supported by the pivot arms.

8. The structure of claim 7 including an eccentric rotatably mounted on the tower frame and a stop member on the pivot arms engageable with the eccentric when the module is in its first position to provide said nip whereby said nip can be adjusted by rotating the eccentric.

9. The structure of claim 8 in which the stop member is a bolt threadedly engaged with one of the pivot arms whereby the position of the stop member is adjustable.

10. The structure of claim 7 including a second module roll rotatably mounted on the module and being positioned adjacent the first-mentioned module roll when the module is in its first position to provide a nip therebetween, the pivot arms being pivotable away from the second module roll when the module is in its second position to move the first module roll away from the second module roll to provide access to the second module roll.

11. The structure of claim 10 including nip-adjusting means on the pivot arms and on the module frame for pivoting the pivot arms relative to the module frame when the module is in its first position for adjusting the nip between the first and second module rolls.

12. The structure of claim 11 in which the nip-adjusting means includes an eccentric rotatably mounted on one of the module frame and the pivot arms and a stop member on the other of the module frame and pivot arms, the stop member engaging the eccentric when the module is in its first position.

13. The structure of claim 7 including a shaft rotatably supporting the pivot arms and fastening means removably securing the shaft to the module frame whereby the pivot arms and module roll can be removed from the module frame by removing the fastening means.

14. The structure of claim 7 in which the module is a printing unit and includes an ink fountain assembly removably mounted on the module frame.

15. In a business forms machine having a tower frame and an impression roll mounted on the tower frame, an offset printing module removably mounted in the tower frame, the printing module comprising:

a module frame, a blanket roll assembly removably mounted on the module frame, said blanket roll assembly including a pair of pivot arms pivotally supported on the module frame and a blanket roll rotatably mounted on the pivot arms, a plate roll assembly removably mounted on the module frame, the plate roll assembly including a plate roll and a pair of end support members rotatably supporting the plate roll, the end support members being removably secured to the module frame, means on the module frame for supplying ink to the plate roll, first and second rail means supporting the module and being supported by the tower frame for permitting the module to be slidably moved out of the main frame on the rail means to a service position, the module being pivotable on the first rail means between a first position in which the blanket roll is positioned adjacent the impression roll to provide a nip for a paper web between the rolls and a second position in which the blanket roll is spaced from the impression roll and the module can be slidably moved out of the tower frame on the first and second rail means, module support means on the tower frame for moving the module between said first and second positions, whereby the plate roll can be exposed for changing a printing plate thereon by moving the module to its service position and pivoting the pivot arms and the blanket roll away from the plate roll and whereby the repeat printed by the plate roll can be changed by moving the module to its service position and removing the blanket roll assembly and the plate roll assembly from the module frame and substituting different blanket roll and plate roll assemblies.

16. The structure of claim 15 including nip-adjusting means on the tower frame and the module for pivoting the blanket roll relative to the impression roll when the module is in its first position for adjusting the nip between the blanket roll and the impression roll.

17. The structure of claim 15 including an eccentric rotatably mounted on one of the tower frame and the blanket roll assembly and a stop member on the other of the main frame and the blanket roll assembly, the stop member engaging the eccentric when the module is in its first position to provide said nip whereby the nip can be adjusted by rotating the eccentric.

18. The structure of claim 15 including an eccentric rotatably mounted on one of the blanket roll assembly and the plate roll assembly and a stop member on the other of the blanket roll assembly and the plate roll assembly, the stop member engaging the eccentric when the module is in its first position to provide a nip between the plate roll and the blanket roll whereby the nip between the plate roll and the blanket roll can be adjusted by rotating the eccentric.

19. The structure of claim 18 including a crank arm connected to the eccentric and power cylinder means connected to the crank arm for rotating the eccentric.

20. The structure of claim 15 in which the centers of the impression roll, the blanket roll, and the plate roll are substantially horizontally aligned.

21. The structure of claim 15 in which the ink supplying means include a pair of form rolls rotatably mounted on the module frame and contacting the plate roll, a first vibrating roll rotatably mounted on the module frame and contacting each of the form rolls, a pair of distributor rolls rotatably mounted on teh module frame and contacting the first vibrator roll, and a second vibrator roll rotatably mounted on the module frame and contacting each of the distributor rolls, the centers of the blanket roll and the first and second vibrator rolls being substantially aligned with a horizontal line extending through the center of the impression roll, the centers of the two form rolls lying on opposite sides of said horizontal line, and the centers of the two distributor rolls lying on opposite sides of said horizontal line whereby the rolls of the printing module are substantially horizontally arranged.

22. The structure of claim 21 in which the ink supplying means further includes an ink fountain assembly removably secured to the module frame whereby the ink fountain assembly can be removed and replaced with another ink fountain assembly.

23. The structure of claim 21 including a plurality of replacement blanket roll assemblies and a plurality of replacement plate roll assemblies for changing the repeat printed by the plate roll without changing the horizontal distance between the impression roll and the first vibrator roll, each of the replacement blanket roll assemblies including a pair of pivot arms rotatably supporting a replacement blanket roll of a different diameter, the pivot arms of each of the replacement blanket assemblies being adapted to be pivotally connected to the module frame when said first-mentioned blanket roll assembly is removed from the module frame with the center of the replacement blanket roll being aligned with said horizontal line, each of the plate roll assemblies including a replacement plate roll of a different diameter and a pair of end support members rotatably supporting the replacement plate roll, the end support members of the replacement blanket roll assemblies being adapted to be connected to the module frame when the first-mentioned plate roll assembly is removed from the module frame, the center of each replacement plate roll being positioned a different distance from said horizontal line.

24. The structure of claim 23 in which each of the plate roll assemblies has a plate roll having a circumference equal to the repeat length of the printing module multiplied by an integer and each of the blanket roll assemblies has a blanket roll having a circumference equal the repeat length of the printing module multiplied by an integer.

* * * * *